US009895563B2

(12) United States Patent
Chen

(10) Patent No.: US 9,895,563 B2
(45) Date of Patent: Feb. 20, 2018

(54) FIRE SPRINKLER WITH IMPROVED PROTECTIVE SHELL

(71) Applicant: PROTECTOR SAFETY IND., LTD., Taoyuan County (TW)

(72) Inventor: Jung-Wen Chen, Taoyuan County (TW)

( * ) Notice: Subject to any disclaimer, the term of this patent is extended or adjusted under 35 U.S.C. 154(b) by 490 days.

(21) Appl. No.: 14/191,437

(22) Filed: Feb. 27, 2014

(65) Prior Publication Data

US 2015/0136432 A1 May 21, 2015

(30) Foreign Application Priority Data

Nov. 19, 2013 (TW) ..... 102221573 U

(51) Int. Cl.
*A62C 37/11* (2006.01)
*A62C 35/68* (2006.01)
*A62C 37/14* (2006.01)

(52) U.S. Cl.
CPC ..... *A62C 37/11* (2013.01); *A62C 35/68* (2013.01); *A62C 37/14* (2013.01)

(58) Field of Classification Search
CPC .. A62C 37/12; A62C 3/06; A62C 3/00; A62C 31/02; A62C 37/10; A62C 37/11; A62C 35/68
USPC ..... 169/37, 57
See application file for complete search history.

(56) References Cited

U.S. PATENT DOCUMENTS 3,393,746 A * 7/1968 Hodnett ..... A62C 37/12 169/41
3,633,676 A * 1/1972 Gloeckler ..... A62C 37/09 169/40
3,714,989 A * 2/1973 Gloeckler ..... A62C 37/09 169/19
3,727,695 A * 4/1973 Danton ..... A62C 37/08 169/37
3,756,321 A * 9/1973 Gloeckler ..... A62C 37/09 169/40
3,783,947 A * 1/1974 Dix ..... A62C 37/12 169/40
3,998,273 A * 12/1976 Juliano ..... A62C 37/12 169/37

* cited by examiner

*Primary Examiner* — Steven J Ganey
*Assistant Examiner* — Chee-Chong Lee
(74) *Attorney, Agent, or Firm* — Chun-Ming Shih

(57) ABSTRACT

A fire sprinkler includes a valve body and a protective shell. The valve body defines therein an orifice being normally fitted with a cap. The valve body is provided with two opposing bars extending downwardly from two sides thereof to form a frame that supports a heat-activated glass bulb engaged between the cap and a bottom of the frame. The protective shell can be mounted to the opposing bars to surround the glass bulb. Each of the opposing bars is provided with a stop portion. The protective shell is provided with two opposing guide portions and two opposing engagement portions, wherein each guide portion of the protective shell receives one of the opposing bars to allow the engagement portions of the protective shell to be engaged with the stop portions of the opposing bars. It allows the protective shell to be mounted to the valve body more securely.

6 Claims, 6 Drawing Sheets

(A-A)

FIRE SPRINKLER WITH IMPROVED PROTECTIVE SHELL

TECHNICAL FIELD OF THE INVENTION

The present invention relates to a fire sprinkler and, more particularly, to a fire sprinkler containing an improved protective shell.

DESCRIPTION OF THE PRIOR ART

As commonly known, fire sprinklers are usually installed in a building for fire protection. To detect a fire, the existing fire sprinklers employ a valve body provided with a heat-activated glass bulb that can urge against the orifice cap of the valve body. With this type of fire sprinkler, when a fire occurs, due to a high temperature, the heat-activated glass bulb can break and thus water can flow out of the orifice of the valve body to produce a water spray to extinguish the flames.

Generally, the valve body employed in the conventional fire sprinklers is provided with two opposing bars that can form a frame to support the heat-activated glass bulb. Also, the valve body is mounted with a protective shell around the opposing bars of the frame of the valve body to protect the glass bulb from being damaged while in normal condition. For this purpose, the protective shell is provided with internal threads while the opposing bars of the frame are provided with external threads. Through the engagement between the internal threads of the protective shell and the external threads of the opposing bars, the protective shell can be mounted to the valve body. However, the threaded structure of the conventional fire sprinklers has the following disadvantages:

1. The contact area between the protective shell and the opposing bars of the frame is limited, and thus the protective shell is easy to be shaken when it is subject to an external vibration, which may result from a construction activity or an earthquake, or the protective shell is easy to be tilted when it is touched by other pipes. Thus, the mounting stability and robustness of the protective shell with the opposing bars of the frame is inadequate.
2. Although the protective shell can provide a protection for the heat-activated glass bulb, it can cause poor ventilation within the protective shell and thus the capability of the glass bulb to detect a high temperature in a mom can be reduced.

SUMMARY OF THE INVENTION

In view of the foregoing, one object of the present invention is to provide a fire sprinkler that can solve the problem of the inadequate robustness of a mounting between the protective shell and the valve body.

To achieve the above object, two embodiments of the present invention concerning the fire sprinkler are disclosed, each of which comprises a valve body and a protective shell. The valve body defines therein an orifice that is normally fitted with a cap. The valve body is provided with two opposing bars extending downwardly from two sides thereof to form a frame that supports a heat-activated glass bulb located between the two opposing bars and engaged between the cap and a bottom of the frame. The protective shell can be mounted to the opposing bars of the frame so as to surround the heat-activated glass bulb. Each of the opposing bars is provided with a stop portion at an outer side surface thereof. The protective shell is provided with two opposing guide portions at an inner surface thereof and is provided with two opposing engagement portions in cooperation with the guide portions, wherein each guide portion of the protective shell receives one of the opposing bars, so that the opposing bars can be guided to move relative to the protective shell in a linear direction to allow the engagement portions of the protective shell to be engaged with the stop portions of the opposing bars.

According to one feature of the embodiments of the present invention, in mounting the fire sprinkler of the present invention, the protective shell can be moved linearly, rather than being moved rotationally as in the conventional devices, to adjust the height of the protective shell. This feature allows the position of the protective shell to be adjusted more quickly and conveniently as compared with the conventional one. Furthermore, through the confining function of the guide portions of the protective shell, the protective shell and the valve body can be mounted more securely, and thus the protective shell can resist vibrations or impacts from construction activity or earthquake.

More specifically, each guide portion is formed into a channel-like member that has two side walls and defines a channel therebetween. The two side walls of the channel-like member receives one of the opposing bars to confine the associated bar to moving along the channel. Each engagement portion can be formed on a bottom of the channel of the channel-like member or the two side walls of the channel-like member. Accordingly, the position of the engagement portions of the protective shell relative to the stop portions of the opposing bars can be adjusted, so that the protective shell can be mounted to the valve body at an appropriate height.

More specifically, each stop portion is formed into a tooth-like surface whereas each engagement portion is formed into an elastic tongue-shaped member or an elastic hook capable of engaging with the tooth-like surface. Accordingly, the position of the engagement portions of the protective shell relative to the stop portions of the opposing bars can be adjusted, so that the protective shell can be mounted to the valve body at an appropriate height.

More specifically, each stop portion defines a plurality of notches or rounded grooves being arranged at regular intervals whereas each engagement portion is formed into an elastic hook or provided with an elastically driven ball to be engaged with one of the notches or one of the rounded grooves. Accordingly, the position of the engagement portions of the protective shell relative to the stop portions of the opposing bars can be adjusted, so that the protective shell can be mounted to the valve body at an appropriate height.

Another object of the present invention is to provide a fire sprinkler that can solve the problem of the reduced capability of the heat-activated glass bulb resulting from the provision of the protective shell.

To achieve the above object, the protective shell can be defined with at least one ventilation hole to increase the thermal transfer. The ventilation hole can have various forms, such as a circular hole, a rectangular hole, a number of elongated rectangular holes, an array of square holes and the like. The ventilation hole can speed up the heated ambient air flowing into the protective shell to allow the glass bulb therein to get broken more easily, so that the time required to break the glass bulb can be shortened, and thus the fire detection capability of the fire sprinkler can be increased.

Other objects, advantages, and novel features of the present invention will become more apparent from the following detailed description when taken in conjunction with the accompanying drawings.

DETAILED DESCRIPTION OF THE PREFERRED EMBODIMENTS

FIGS. 1 through 4 show a first embodiment of the present invention concerning a fire sprinkler, which generally comprises a valve body 10 and a protective shell 20.

Figure 1:
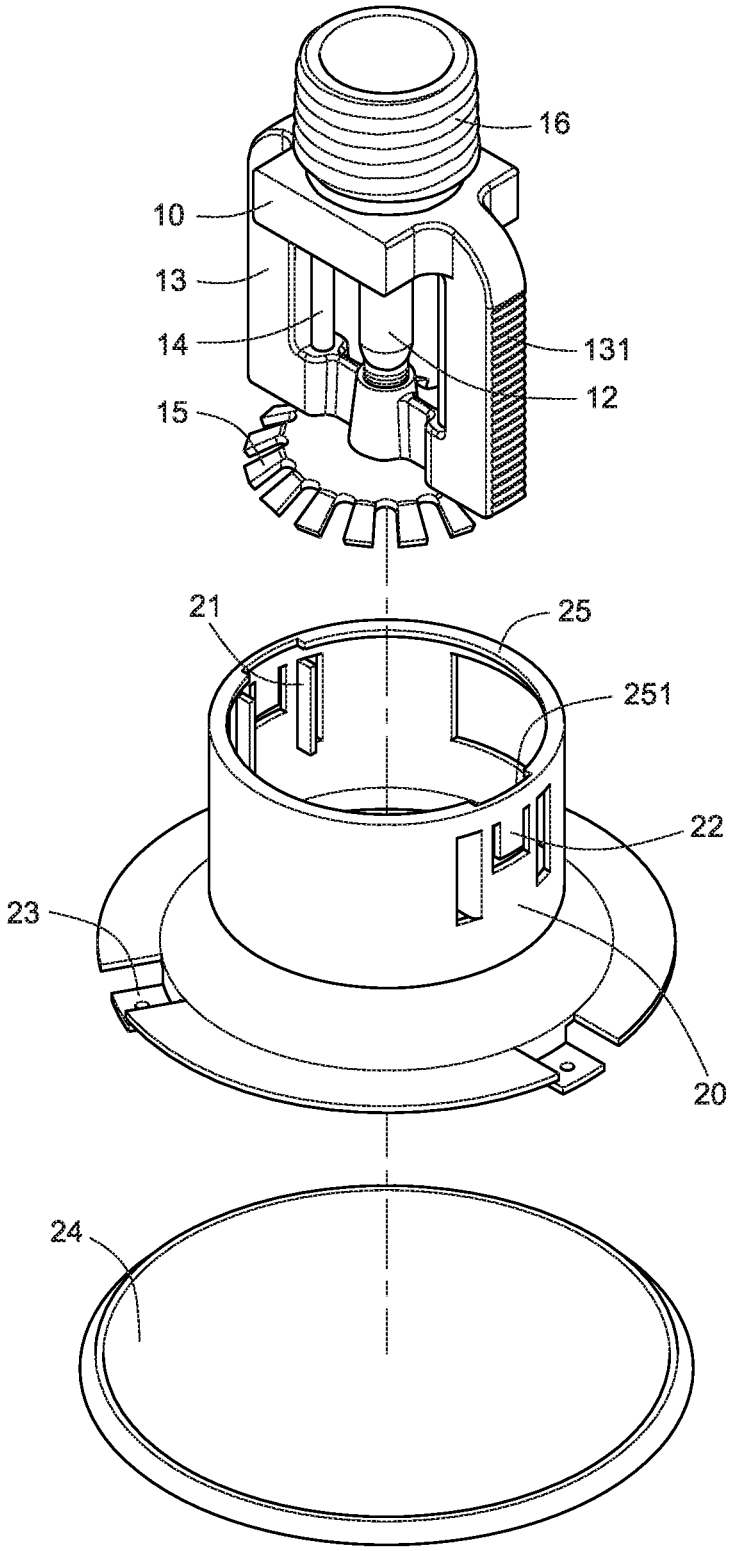
FIG. 1 shows an exploded view of a first embodiment of the present invention.
Figure 2:
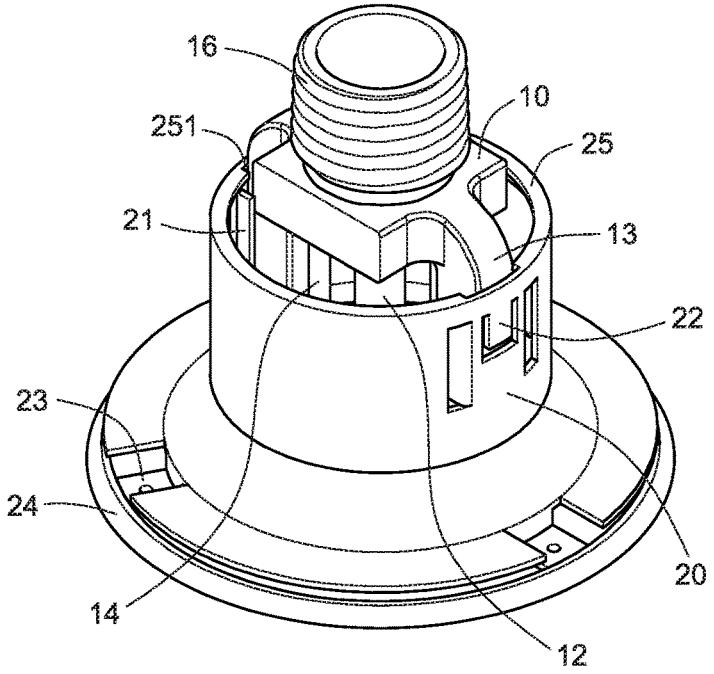
FIG. 2 shows an assembled view of the first embodiment of the present invention.
Figure 3:
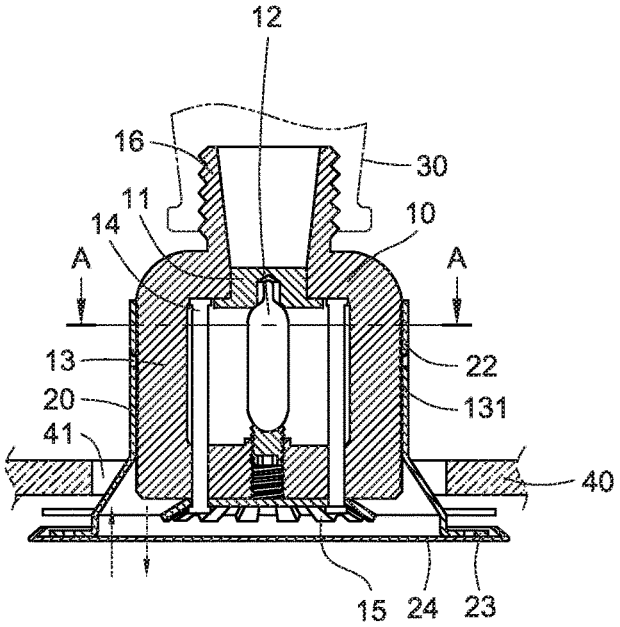
FIG. 3 shows a sectional working view of the first embodiment of the present invention, wherein the fire sprinkler is installed at the ceiling.
Figure 4:
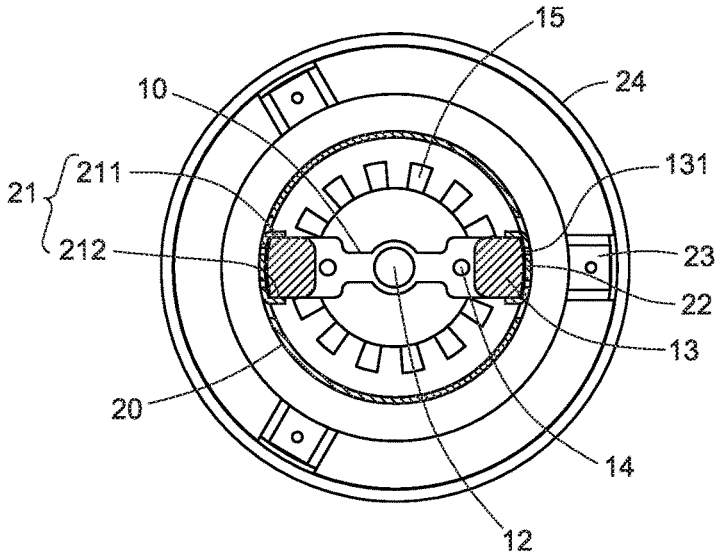
FIG. 4 shows a sectional view taken along A-A line in FIG. 3.

As shown in FIG. 3, the fire sprinkler is installed at a ceiling 40. For fire protection, the fire sprinkler should extend through an opening 41 of the ceiling 40. The valve body 10 is provided with a threaded portion 16 at its top, through which a water supply pipe 30 for fire protection can be connected to the fire sprinkler. Furthermore, the valve body 10 defines therein an orifice that is normally fitted with a cap 11, which is urged by a heat-activated glass bulb 12 so as to close the orifice and thus prevent water flowing from the orifice while in normal condition. The valve body 10 is provided with two opposing bars 13 extending downwardly from two sides thereof to form a frame that can support the heat-activated glass bulb 10 being located between the two opposing bars 13 and being engaged between the cap 11 and a bottom of the frame. The frame, being constructed of the two opposing bars 13, is provided with two slidable posts 14 that are connected to a deflector 15 at their bottom ends. Thus, in a fire emergency, water can flow from the orifice of the valve body 10 to impact the deflector 15 so as to produce a specific water spray pattern, which can increase the water distribution area.

The protective shell 20 has a generally cylindrical shape and is formed with an inwardly extending flange 25 at its top. The inwardly extending flange 25 defines two opposing indentations 251. The inside diameter of the inwardly extending flange 25 is less than the dimension of the valve body 10. The maximum distance between the indentations 251 is greater than the dimension of the valve body 10. As such, the valve body 10 can be mounted with the protective shell 20 in a limited manner, thereby facilitating the protective shell 20 to be mounted to the valve body 10. Furthermore, the protective shell 20 is formed with circular flange at its bottom. The circular flange is formed with an attachment tab 23 that can be bonded to a bottom plate 24 through a low melting-point metal, such as tin. As such, in a fire emergency, the low melting-point metal can be melted, and this will cause the bottom plate 24 to fall down to allow high-temperature air to go into the protective shell 20, thereby causing the heat-activated glass bulb 12 to break, which in turn causes the cap 11 to fall down, and thus permits water flowing out of the orifice of the valve body 10.

The protective shell 20 can be mounted to the opposing bars 13 of the frame of the valve body 10 to surround the valve body 10 and the heat-activated glass bulb 12. To describe in more detail, each of the opposing bars 13 is provided with a stop portion 131 at an outer side surface thereof; the protective shell 20 is provided with two opposing guide portions 21 at an inner surface thereof and is provided with two opposing engagement portions 22 in cooperation with the two guide portions 21, wherein each guide portion 21 of the protective shell 20 is capable of receiving one of the opposing bars 13 of the frame, so that the opposing bars 13 can be guided to move relative to the protective shell 20 in a linear direction to allow the engagement portions 22 of the protective shell 20 to be engaged with the stop portions 131 of the opposing bars 13. To describe in more detail, each guide portion 21 can be produced through a punching process to form a channel-like member that has two side walls 211 and defines a channel 212 therebetween, wherein the two side walls 211 can receive one of the opposing bars 13 to confine the associated bar 13 to moving along the channel 212 To describe in more detail, each engagement portion 22 of the protective shell 20 can be formed into an elastic tongue-shaped member, which can be engaged with the stop portion 131 of one bar of the frame, so that the position of the engagement portions 22 of the protective shell 20 relative to the stop portions 131 of the opposing bars 13 can be adjusted, and thus the protective shell 20 can be mounted to the valve body 10 at an appropriate height. As such, when installing the fire sprinkler of the present invention, the height of the protective shell 20 can be adjusted according to the height of the ceiling 40 of a site, so that the protective shell 20 can be prevented from extending out of the ceiling 40 too much, so that the overall appearance of the ceiling 40 of the site will not be downgraded.

Figure 5:
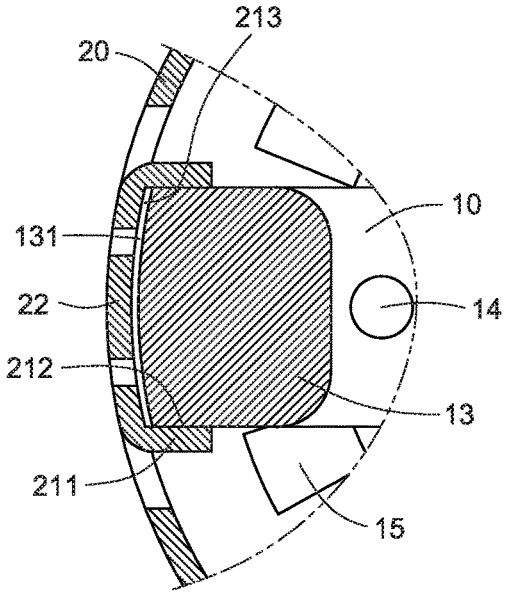
FIG. 5 shows an enlarged fragmentary view of an embodiment with regard to the disposition of the engagement portion and the stop portion shown in FIG. 4.
Figure 6:
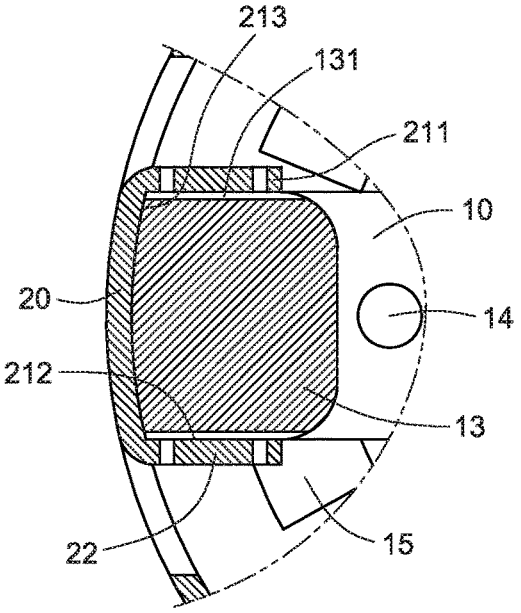
FIG. 6 shows an enlarged fragmentary view of another embodiment with regard to the disposition of the engagement portion and the stop portion shown in FIG. 4.

FIGS. 5 and 6 show enlarged views of different embodiments with regard to the disposition of the engagement portions 22 of the protective shell 20 and the guide portions 131 of the opposing bars 13, wherein the engagement portions 22 can be formed on a bottom 213 of the channel 212 of the channel-like member (see FIG. 5), or alternatively, the engagement portions 22 can be formed on the two side walls 211 of the channel-like member (see FIG. 6). Each embodiment allows the engagement portions 22 of the protective shell 20 to be engaged with the stop portions 131 of the opposing bars 13 of the frame, so that the protective shell 20 can be mounted to the valve body 10 at an appropriate height.

Figure 7:
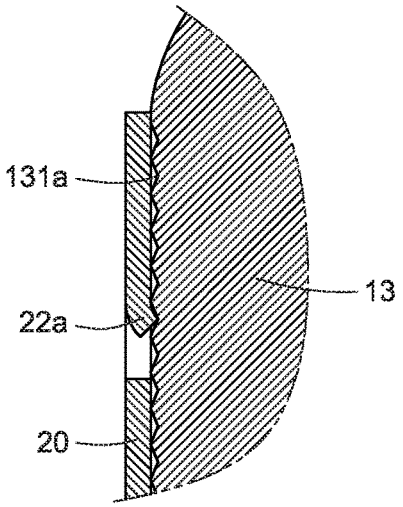
FIG. 7 shows an enlarged fragmentary view of an embodiment with regard to the mounting between the stop portion and the engagement portion shown in FIG. 3.

FIG. 7 shows an enlarged view of an embodiment with regard to the mounting between the guide portions 131 of the opposing bars 13 and the engagement portions 22 of the protective shell 20, wherein each stop portion 131 defines a plurality of notches 131*a* being arranged at regular intervals. In addition to the guide portions 131 being formed into a tooth-like surface, the engagement portions 22 are formed into an elastic hook 22*a*, for example, through a punching process, wherein the elastic hook 22*a* has one end being curved towards to the guide portions 13 so that it can be inserted into one of the notches 131*a*, thereby allowing the elastic hook 22*a* to engage with the notches 131*a*. As such, the position of the engagement portions 22 of the protective shell 20 relative to the stop portions 131 of the opposing bars 13 can be adjusted, so that the protective shell 20 can be mounted to the valve body 10 at an appropriate height.

Figure 8:
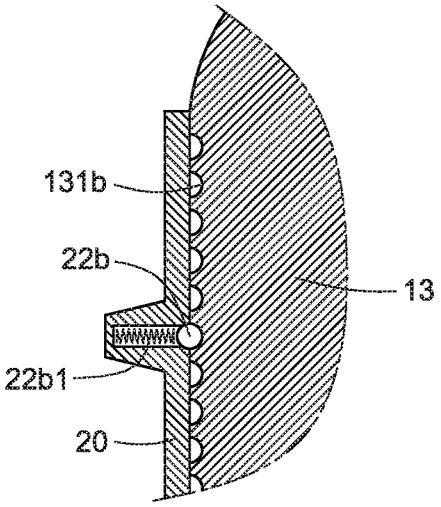
FIG. 8 shows an enlarged fragmentary view of another embodiment with regard to the mounting between the stop portion and the engagement portion shown in FIG. 3.
Figure 9:
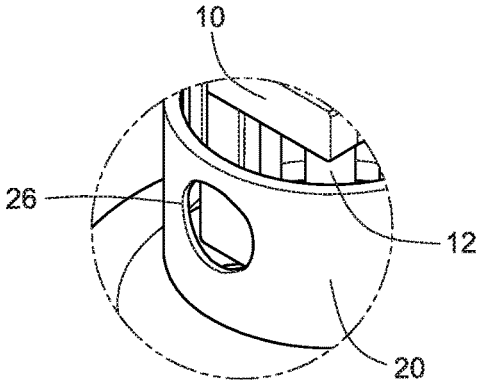
FIG. 9 shows an enlarged fragmentary view of the protective shell shown in FIG. 2, wherein a circular ventilation hole is added to the protective shell.
Figure 10:
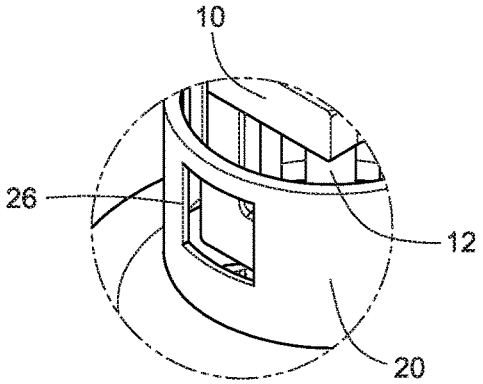
FIG. 10 shows an enlarged fragmentary view of the protective shell shown in FIG. 2, wherein a rectangular ventilation hole is added to the protective shell.
Figure 11:
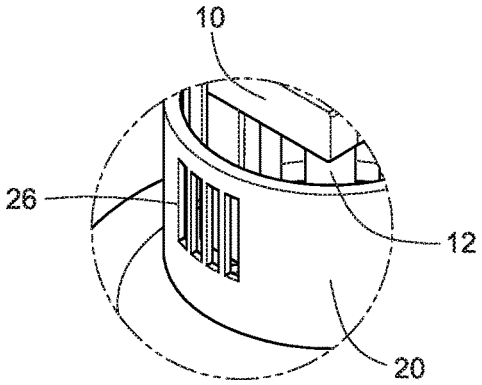
FIG. 11 shows an enlarged fragmentary view of the protective shell shown in FIG. 2, wherein a number of elongated rectangular ventilation holes are added to the protective shell.
Figure 12:
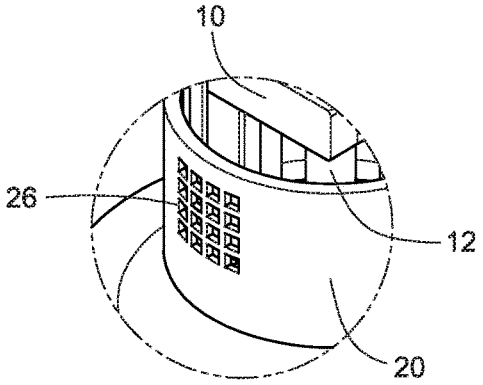
FIG. 12 shows an enlarged fragmentary view of the protective shell shown in FIG. 2, wherein an array of square ventilation holes is added to the protective shell.

FIG. 8 shows an enlarged view of another embodiment with regard to the mounting between the guide portions 131 of the opposing bars 13 and the engagement portions 22 of the protective shell 20, wherein each stop portion 131 defines a plurality of rounded grooves 131*b* being arranged at regular intervals. In addition, the engagement portions 22 is provided with an elastically driven ball 22*b* that can provide elasticity through an elastic member 22*b*1, such as a compression spring, to allow the ball 22*b* to engage with one of the rounded grooves 131*b*. As such, the position of the engagement portions 22 of the protective shell 20 relative to the stop portions 131 of the opposing bars 13 can be adjusted, so that the protective shell 10 can be mounted to the valve body 10 at an appropriate height.

FIGS. 9 through 12 show enlarged views of different embodiments of ventilation hole for the protective shell of the fire sprinkler. As shown, the protective shell 20 can be defined with at least one ventilation hole 26, which can be formed through a punching process and can be shaped as a circular hole (see FIG. 9), a rectangular hole (see FIG. 10), a number of elongated rectangular holes (see FIG. 11), or an array of square holes (see FIG. 12). The ventilation hole 26 can speed up the heated ambient air flowing into the protective shell 20 to allow the glass bulb 12 therein to get broken more easily, so that the time required to break the glass bulb 12 can be shortened, and thus the capability of the fire sprinkler to detect a fire emergency can be increased.

Figure 13:
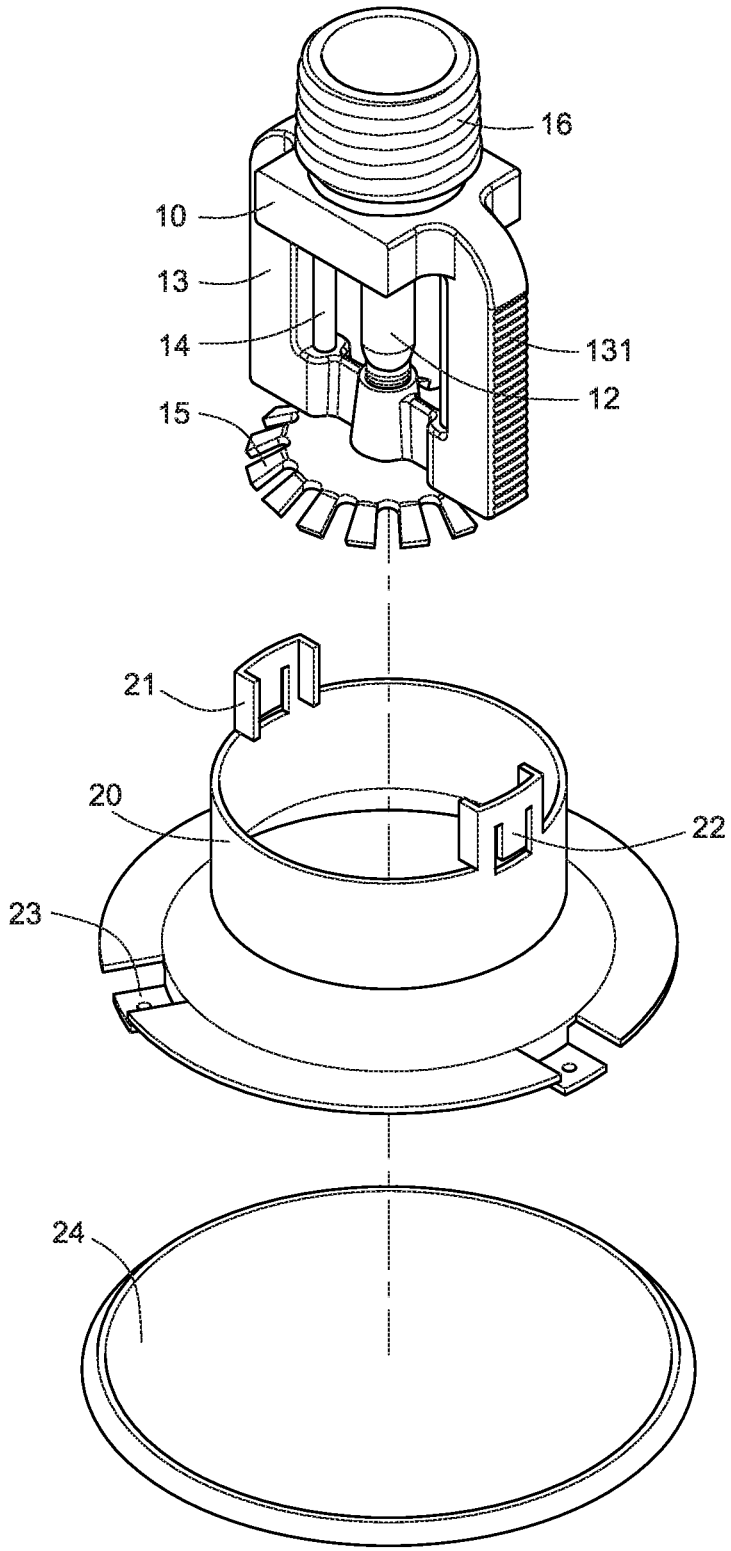
FIG. 13 shows an exploded view of a second embodiment of the present invention.

FIG. 13 shows a second embodiment of the present invention, wherein the guide portions 21 and the engagement portions 22 are designed to project from the top end of the protective shell 20 instead of the inwardly extending flange 25 provided in the first embodiment. The projected guide portions 21 of the protective shell 20 can guide the opposing bars 13 to move relative to the protective shell 20 and to facilitate the engagement portions 22 of the protective shell 20 to be engaged with the stop portions 131 of the opposing bars 13. With such structure, in addition to the convenience of the protective shell 20 being mounted to the valve body 10, due to a larger opening existed between the two projected guide portions 21, the ambient air flowing into the protective shell 20 can be significantly increased, so that the response time of the heat-activated glass bulb 12 can be shortened, and thus the response speed of the fire sprinkler to a fire emergency can be increased.

In light of the foregoing, the protective shell can be moved linearly, rather than being moved rotationally as in the conventional devices, to adjust the height of the protective shell while installing the fire sprinkler. This feature allows the position of the protective shell to be adjusted more quickly and conveniently as compared with the conventional one. Furthermore, through the confining function of the guide portions of the protective shell, the protective shell can be mounted to the valve body more securely, and thus the protective shell can resist vibrations or impacts resulting from construction activity or earthquake more effectively.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A fire sprinkler, comprising:

a valve body defining therein an orifice that is fitted with a cap, the valve body being provided with two opposing bars extending downwardly from two sides thereof to form a frame that supports a heat-activated glass bulb located between the two opposing bars and engaged between the cap and a bottom of the frame, wherein a slidable post is located between the heat-activated glass bulb and each of the two opposing bars, one end of the slidable post is connected to one of the two opposing bars and the other end of the slidable post is passed through the bottom of the frame to be connected to a deflector; and a protective shell being mounted to the two opposing bars of the frame so as to surround the heat-activated glass bulb;

wherein each of the two opposing bars is provided with a stop portion at an outer side surface thereof; the protective shell is provided with two opposing guide portions at an inner surface thereof and is provided with two opposing engagement portions in cooperation with the two opposing guide portions, wherein each of the two opposing guide portions of the protective shell receives one of the two opposing bars, so that the two opposing bars can be guided to move relative to the protective shell in a linear direction to allow the two opposing engagement portions of the protective shell to be engaged with two stop portions of the two opposing bars;

wherein each of the two opposing guide portions is formed by two rails with a channel defined therebetween, the two rails directly contact and are parallel to two corresponding sides of each of the two opposing bars, so that one of the two opposing bars is guided by the two rails to slidably move along the channel, and the position of the two opposing engagement portions relative to the two stop portions is adjustable;

wherein cross sections of each of the two opposing bars and each of the two opposing guide portions are substantially formed in rectangle shape and fitted with each other, and each of the two rails is substantially perpendicular to each of the two stop portions;

wherein the protective shell has a circumferential flange with two equally opposing indentations that are axially aligned with the two opposing engagement portions, respectively, to allow the insertion of the valve body into the protective shell, and each of the two opposing guide portions is axially aligned within the protective shell and disposed on two sides of the engagement portion.

2. The fire sprinkler of claim 1, wherein each of the two engagement portions is formed on the channel or on one of the two rails.

3. The fire sprinkler of claim 1, wherein each of the two stop portions is formed into a tooth-like surface whereas each of the two opposing engagement portions is formed into an elastic tongue-shaped member or an elastic hook capable of engaging with the tooth-like surface.

4. The fire sprinkler of claim 1, wherein each of the two stop portions defines a plurality of notches or rounded grooves being arranged at regular intervals whereas each of the two opposing engagement portions is formed into an elastic hook or provided with an elastically driven ball to be engaged with one of the plurality of notches or one of the plurality of rounded grooves.

5. The fire sprinkler of claim 1, wherein the protective shell defines at least one ventilation hole, through which ambient air can flow into the protective shell to transfer heat to the heat-activated glass bulb.

6. The fire sprinkler of claim 5, wherein the at least one ventilation hole is shaped as a circular hole, a rectangular hole, a number of elongated rectangular holes, or an array of square holes.

* * * * *